US011815265B2

(12) United States Patent
van Diepen et al.

(10) Patent No.: US 11,815,265 B2
(45) Date of Patent: Nov. 14, 2023

(54) GRATE BAR FOR STEPPED GRATE

(71) Applicant: Alite GmbH, Neustadt (DE)

(72) Inventors: Nicolaas van Diepen, Garbsen (DE); Thomas Weiss, Neustadt (DE); Moritz Hagendorf, Neustadt (DE); Christoph Tyblewski, Neustadt (DE)

(73) Assignee: IKN GMBH

( * ) Notice: Subject to any disclaimer, the term of this patent is extended or adjusted under 35 U.S.C. 154(b) by 0 days.

(21) Appl. No.: 17/728,581

(22) Filed: Apr. 25, 2022

(65) Prior Publication Data

US 2022/0252261 A1 Aug. 11, 2022

Related U.S. Application Data

(63) Continuation of application No. PCT/EP2020/079867, filed on Oct. 23, 2020.

(30) Foreign Application Priority Data

Oct. 29, 2019 (DE) ..... 10 2019 129 171.2

(51) Int. Cl.

| | |
|---|---|
| ***F23H 1/02*** | (2006.01) |
| ***F23H 7/08*** | (2006.01) |
| ***F23G 5/00*** | (2006.01) |
| ***F23H 17/02*** | (2006.01) |

(52) U.S. Cl.

CPC ..... *F23H 7/08* (2013.01); *F23G 5/002* (2013.01); *F23H 1/02* (2013.01); *F23H 17/02* (2013.01); *F23H 2700/009* (2013.01)

(58) Field of Classification Search

CPC ... F23H 7/08; F23H 7/06; F23H 17/02; F23H 17/08; F27B 21/02; F27D 15/022; C10J 3/34; C10J 3/36

See application file for complete search history.

(56) References Cited

U.S. PATENT DOCUMENTS 3,624,920 A 12/1971 Coutelan
4,200,047 A * 4/1980 Knorr ..... F27B 21/02 110/268
5,549,471 A * 8/1996 Tegtmeier ..... F27D 15/022 432/83

(Continued)

FOREIGN PATENT DOCUMENTS

DE 2000631 A1 * 7/1970
DE 2345734 A * 3/1975 ..... F23H 17/12

(Continued)

OTHER PUBLICATIONS

PCT International Search Report and Written Opinion, PCT/EP2020/079867, dated Jan. 26, 2021, 13 pages.

(Continued)

*Primary Examiner* — Gregory A Wilson

(74) *Attorney, Agent, or Firm* — Quarles & Brady LLP; Yakov S. Sidorin

(57) ABSTRACT

Embodiments of the invention relate to a grate bar front section and a matching grate bar rear section and to a grate bar including the grate bar front section and/or the grate bar rear section configured such that, by releasably connecting the grate bar front section to the grate bar rear section, manufacture and maintenance costs are reduced.

20 Claims, 12 Drawing Sheets

(56) References Cited

U.S. PATENT DOCUMENTS

| | | | | |
|---|---|---|---|---|
| 5,947,719 | A * | 9/1999 | Heinemann | F27D 15/022 432/78 |
| 2004/0159269 | A1 | 8/2004 | Williams et al. | |
| 2006/0011114 | A1 * | 1/2006 | Esser | F23H 3/02 110/298 |
| 2017/0276348 | A1 * | 9/2017 | Hammerich | F23H 7/08 |

FOREIGN PATENT DOCUMENTS

| | | | | |
|---|---|---|---|---|
| DE | 7521218 | U | 10/1975 | |
| DE | 2454202 | A1 | 5/1976 | |
| DE | 2604611 | A1 * | 8/1977 | |
| DE | 2930406 | A1 | 2/1981 | |
| DE | 102004034322 | A1 | 2/2006 | |
| DE | 102004045927 | A1 * | 3/2006 | F27D 15/022 |
| DE | 102009016523 | A1 | 11/2010 | |
| DE | 102017100408 | A1 * | 7/2018 | F23H 17/12 |
| EP | 19938 | A * | 12/1980 | F23H 7/08 |
| EP | 0170803 | A1 | 2/1986 | |
| EP | 0437759 | A2 | 7/1991 | |
| EP | 1008806 | A2 | 6/2000 | |
| EP | 1191282 | A1 * | 3/2002 | F23H 17/12 |
| EP | 3048369 | B1 | 5/2017 | |
| KR | 2110167 | B1 * | 5/2020 | F23H 1/02 |
| WO | WO-02052197 | A1 * | 7/2002 | C10J 3/002 |
| WO | WO-2010115541 | A2 * | 10/2010 | F23H 17/12 |

OTHER PUBLICATIONS

European Patent Office, Communication, Application No. 20800035.6, dated Nov. 4, 2022, 4 pages.

Intellectual Property India, Examination Report, Application No. 202217027223, dated Aug. 23, 2022, 6 pages.

* cited by examiner

GRATE BAR FOR STEPPED GRATE

CROSS-REFERENCE TO RELATED APPLICATIONS

This application is a continuation of pending International Application No. PCT/EP2020/079867 filed on Oct. 23, 2020 and now published as WO 2021/083797, which designates the United States and claims priority from German Application No. DE 10 2019 129 171.2 filed on Oct. 29, 2019. The disclosure of each of the above-identified patent applications is incorporated herein by reference.

BACKGROUND

1. Field of the Invention

The invention relates to a grate bar front section and a matching grate bar rear section, as well as a grate bar with the grate bar front section and/or the grate bar rear section.

2. Related Art

Waste incineration is a collective term for waste disposal processes in which waste materials are incinerated. By waste incineration, the original volume of the waste is reduced. One method of waste incineration is grate firing. Hereby, step grates and/or feed grates can be used, among others. Hereby, the grate consists of several rows of grate bars, which are usually laterally braced. The various rows of the grates overlap one another, wherein the front section of the respective grate bars overlaps the rear section of the grate bars located downstream with respect to the conveying direction. In this way a flat staircase is formed, on which the waste to be incinerated is pushed forward by an oscillating movement. Depending on their position in the feeding grate, the grate sections can be air-cooled and/or water-cooled. A lateral division into two or more grate tracks is also possible.

EP 3 048 369 B1 discloses a grate bar of a feeding grate for waste incineration. The grate bar is made in one piece from a ceramic composite material. For this purpose, a ceramic matrix is poured into a shell with a bottom and side walls made of sheet metal and a perforated support structure. The grate bar has a grate bar front section for receiving firing material and a rear section which is formed for attachment to a cross-member.

From utility model DE 75 21 218 a grate panel with a base panel is known, onto the rear end of which an abrasion bar 5 is pushed. The front end of the abrasion bar engages in a gap extending in longitudinal direction of the base panel and encompasses with its rear end the rear end of the base panel.

In the published patent application DE 2930406 A, a stepped grate for a clinker cooler is proposed, at which grate panels made of one piece are fastened in rows next to one another on crossbeams. To fasten the grate panels, they are braced from below to the cross-member by means of tie bolts. For this purpose, the tie bolts each have an angled free leg at their top end, which leg engages in a complementary hook-like recess at the bottom side of the respective grate panel.

SUMMARY

The object of the invention is to develop a light-weight, inexpensive grate bar that promotes the processes on the grate and withstands high thermal and mechanical loads, such as those encountered in waste incineration reactors and cement clinker coolers.

This object is achieved by a grate bar front section as described below and a grate bar rear section as described below, which is preferably complementary thereto. These two sections can be connected to one another to form a grate bar, for example as described below. For example, the grate bar can be designed for a waste incineration grate or for a clinker cooler grate and can be used as a part of such. Further advantageous embodiments of the invention are specified in the dependent claims.

The grate bar front section, hereinafter referred to as "front section" for short, can be attached to a grate bar rear section, hereinafter referred to as "rear section" for short, for example as described in detail below. The front section can, for example, be attached to a support structure, e.g. be attached to a cross-member in the usually known way. Alternatively or optionally, the front section can be attached to existing rear sections or directly to at least one support structure, e.g. on a cross-member, of a grate.

The front section includes a refractory mineral material. For example, the front section can consist of or have refractory or highly refractory concrete, preferably ceramic. These materials render the front section insensitive to thermal, mechanical and chemical impacts, such as heat, abrasion or corrosion.

For example, the front section may consist at least substantially (i.e. more than 30%, better more than 50%, preferably more than 75%, more than 85% or more than 90%) of the refractory mineral material. In the following, the term ceramic is used as a pars pro toto for a refractory mineral material. The ceramic can be provided with reinforcements, for example made of steel fibers or other fibers, and furthermore the front section is preferably monolithic. Alternatively, only the topmost centimeters of the top side of the front section can be made of ceramic.

The front section has a top side, a bottom side, a front side, two narrow sides, a rear side, as well as a longitudinal axis of the grate bar extending parallel to the top side through the front side and the rear side. The designations of the sides refer to the conveying direction of the grate, i.e. to the installation position of the grate bar in the finished grate. When the grate bar is installed, the longitudinal axis of the grate bar preferably extends at least approximately parallel to the conveying direction (i.e. it forms an angle of ±20°, preferably ±10°, particularly preferably ±2.5° with the conveying direction or is parallel to the conveying direction). The top side can receive the material to be processed, be it material to be burned (such as waste or wood chips) or cement clinker (clinker for short) to be cooled. The space above the surface is therefore called the reactor for the sake of simplicity, even if chemical processes do not necessarily take place there. For example, the material to be processed can be transported on the top side by an oscillating movement of the grate bars in the direction of the front side. The top side can be in direct contact with the material to be processed and can be exposed to the highest thermal and chemical loads. The bottom side is the side of the front section facing away from the top side. The top side and bottom side are connected to each other by the front side, the rear side and the two narrow sides. As usual, the front side points in the conveying direction and is opposite the rear side. The two narrow sides each connect the front side with the rear side. In the mounted state, the narrow sides of laterally adjacent front sections typically contact each other. The front sections of a row of a grate are referred to as adjacent here, wherein the rows of the grate extend orthogonally to the conveying direction. An (imaginary) grate bar's longitudinal axis of the front section extends through the front side and the rear side. An (imaginary) grate bar vertical axis extends orthogonally to the grate bar longitudinal axis and orthogonally to the at least approximately planar top side. An (imaginary) transverse axis of the grate bars then extends, as usual, orthogonally to the two other axes through the narrow sides and, in the mounted state, corresponds to the longitudinal direction of a row of grate bars and the transverse direction of the grate.

Summarized, the front side delimits the front section in the conveying direction, has a common edge with the top side and the bottom side and is, for example, preferably planar, but it can in principle also have other geometries. The rear side is located at the side of the front section facing away from the front side and consequently has—like the front side—a common edge with the top side and bottom side. The rear side can serve as a contact surface for the rear section and/or a supporting structure of the grate.

The narrow sides each have a common edge with the front side and the rear side, as well as with the top side and the bottom side. The narrow sides extend preferably at least approximately parallel, i.e. ±20°, preferably ±10°, particularly preferred ±2.5° or parallel) to the longitudinal axis of the grate bar.

Starting from the bottom side of the front section, at least one recess can extend from an opening in the bottom side in the direction to the top side. The recess does not necessarily end in an opening in the top side, but preferably below the top side. In this sense, the recess can preferably be a blind hole. The recess has preferably at least one contact surface on the boundary of the recess facing the rear side or the front side. Then the contact surface can introduce a force acting in the direction of the rear side or the front side, respectively, for example in a positive-locking (formschlüssig) manner and/or by a frictional connection (kraftschlüssig), into the front section. The contact surface is preferably convex or planar. Then, via the positive locking or the frictional connection, compressive forces can be introduced into the ceramic of the front section in a way that is gentle on the material. This increases the service life.

Starting from the rear side and/or the front side, a channel can connect the rear side or the front side, respectively, to the recess. The channel preferably has a channel longitudinal axis. The channel can, for example, have a cylindrical, in particular circular-cylindrical contour, i.e. it can be delimited by a corresponding peripheral surface. The channel can preferably taper from the rear side and/or from the front side in the direction of the recess, for example taper continuously. The channel can also be at least partially open to the bottom side.

As explained in more detail below, the channel can, for example, accommodate a bolt or another connecting element for fastening, preferably bracing, of the front section to a rear section. With the at least one contact surface, the recess offers an abutment for bracing the connecting element and also offers access to the connecting element or to the channel, respectively. The channel, together with the recess, therefore makes it possible to connect the front section to a rear section and/or a front panel, preferably in a releasable manner. The rear section, which is subject to only little wear, can therefore be reused, e.g. if the corresponding front section is worn out or otherwise damaged and is exchanged. In addition, the front section, the optional rear section and/or the one optional front panel can be made from different materials, which allows to inexpensively adapt the front section, the optional rear section to their respective tasks. The same applies correspondingly to an optional front panel.

Herein the term bolt is used as a pars pro toto for a connecting element. The term bolt could therefore be simply exchanged by the term connecting element, but this in particular includes the typical connecting bolt, e.g. a threaded bolt.

The ceramic renders the front section resistant to corrosion and wear. Ceramics also have a high permissible operating temperature. The ceramics renders the front section dimensionally stable also at high temperature loads and in addition has a low specific weight. The disadvantages of the ceramic material are a rather low tensile strength and its brittle behavior. Therefore, the tensile stress exerted on the grate bar must be minimized. In contrast to the low tensile strength, ceramics and the other preferred refractory materials have a high compressive strength at high temperatures. With the described bolt attachment, the ceramics is at least essentially only pressure-loaded by the attachment.

The preferred tapering of the channel facilitates demolding of the front section from a mold, because the front section can be easily released from the mold by pivoting and/or rotating movements and frictional forces are minimized.

Another advantage of the optional tapering of the channel is the facilitation of later mounting at or dismounting from a complementary rear section or a front panel, respectively. For example, a bolt can be inserted more easily into the channel during mounting. Furthermore, a bolt that may be stuck can, by a pivoting movement be released quickly and easily during dismounting. The risk of the bolt sticking to the edge of the channel is greatly reduced, if not eliminated.

Starting from the rear and/or bottom side, preferably at least one gas line can extend in the direction of the top and/or front side and open into the top and/or front side. The number of gas lines may vary as required (i.e. preferably at least one gas line, more preferably two, three or more gas lines). In other words, the at least one gas line connects at least one inlet in the rear side and/or the front side with at least one outlet in the top side and/or the front side. The gas line can be used to cool the front section and, in addition, a process gas ("gas" for short) that heats up as it flows through the gas line can be conveyed to the top side of the front section. The gas can, for example, be air or another gas or gas mixture that promotes combustion, e.g. possibly preheated primary air for waste incineration or other applications. In the application in a cement clinker cooler, the gas may be a cooling gas for cement clinker.

Preferably, at least one section of the at least one gas line is located above a plane which is parallel to the grate bar longitudinal axis and the grate bar trans-verse axis and also above the channel. In the mounted state, the gas line is then arranged above the bolt for fastening the rear section. A gas flowing through the gas line therefore cools the region of the front section located above the bolt (or more generally the connecting element), such that the thermal load on the bolt is reduced. Accordingly, the service life of the bolt is increased, and it can also be dimensioned with lower safety margins.

Consequently, the gas line enables gas to be transported below the front section to the top side of the front section. For example, primary air, e.g. in a waste incineration plant, can flow from the bottom side of the grate to the top side by means of the gas line. Thereby, this primary air heats up, i.e. it absorbs heat from the front section. As a result, the gas reaches the top side of the front section with a higher temperature, and less energy is required to heat the primary and/or secondary air.

The gas line can have a circular cross-section, but the cross-section can also be oval, e.g. elliptical or polygonal.

At least one section of at least one insulating body can be arranged preferably between the channel and the top side and/or preferably between the recess and the top side. The number of insulating bodies can vary (i.e. preferably one insulating body, particularly preferred two, three or more insulating bodies). The insulating body is made of a material with lower thermal conductivity than the ceramics surrounding it and can for example be a rod-shaped body. Such a body can easily be inserted in a mold and thus simply be inserted into the front section. Mineral wool and/or air, for example, can be selected as the insulating medium.

The insulating body reduces the heat input into the section below and thus acts as a thermal barrier. In this way, the thermal load exerted on a bolt lying in the channel can be reduced.

If at least one gas line as described above is provided, the at least one insulating body can preferably be arranged between the gas line and the channel and/or the recess. As a result, the heating of gas flowing through the gas line is not reduced and the heat input into the region of the channel is further reduced.

In particular, if the insulating body is rod-shaped, its longitudinal axis can extend at least approximately (preferably ±10°, particularly preferred ±2.5° or exactly) in the direction of the longitudinal axis of the grate bar and/or the longitudinal axis of the channel. In particular, the insulating body can, for example, be arranged above the channel and thus protect the channel and the optional bolt particularly efficiently from the heat on the top side. Alternatively or additionally, this or another insulating body is aligned at least approximately orthogonally (i.e. ±20°, preferably ±10°, particularly preferred ±2.5° or orthogonally) in relation to the longitudinal axis of the grate bar. This variant is particularly easy to manufacture and good thermal protection of the channel and the bolt can be achieved by a plurality of insulating bodies arranged next to one another.

The insulating body may have a circular cross-section, but the cross-section can also be oval, e.g. elliptical or polygonal. The insulating bodies can be arranged tangentially, overlapping or preferably next to each other, e.g. spaced apart and/or at least approximately parallel to each other (within ±10°, preferably ±5°, particularly preferred ±2.5° or less).

Preferably, at least one gas passage extends from an inlet in the bottom side towards the top side and ends in an outlet in the top side. The number of gas passages can vary as required (i.e. preferably one gas passage, particularly preferred two, three or more gas passages). The at least one gas passage allows gas located below the front section to be transported to the top side of the front section. The gas can be, for example, a process gas for processes taking place on the top side of the grate, for example air or another gas or gas mixture promoting the combustion. For example, by means of the gas passage, e.g. in a waste incineration plant, primary or secondary air can flow from the bottom side of the grate to the top side. Through the gas passage, a homogenous process gas feeding into the reactor or cooling space arranged above the front section can be achieved. Therefore, the processes in the reactor run more evenly and it is operated more economically.

The gas passage may be tilted towards the front side with respect to the inlet. For example, the gas passage can have a longitudinal axis which is tilted in the conveying direction, i.e. in direction to the front side, which longitudinal axis forms an acute angle with the top side. By this, an even combustion on the grate surface is promoted. More generally, the process gas is fed to the processes in the reactor (combustion, cooling, etc.) in a particularly even manner.

Preferably, the gas passage is curved in the direction to the front side at least in a region adjacent to the top side. If a tangent is applied to the lower side of the gas passage in the region adjacent to the top side at a contact point, this tangent forms an acute angle with the top side. With decreasing distance of the contact point of the tangent to the outlet, the value of the angle formed by the tangent and the top side preferably decreases, particularly preferred decreases continuously. In particular, the bottom side of the gas passage at the outlet can merge continuously into the top side. By tilting and/or curving the gas passage, the gas can flow out in the conveying direction and attaches to the surface in the conveying direction. All these measures therefore further increase the homogenization of the processes in the reactor.

At least one optional gas channel can extend, starting from an inlet in the recess, in the direction to the top side and/or the front side and ends, for example, in at least one outlet in the top side and/or the front side. At least a part of the inlet of this gas channel can be arranged in the region of the longitudinal axis of the channel. This gas channel can receive a cooling fluid (e.g. a process gas) that flows over, and thereby cools, a surface of a bolt (or other connection element) seated in the channel after mounting with a rear section. For example, the bolt can be a hollow bolt through the axial recess of which the cooling fluid flows. Additionally or alternatively, the cooling fluid can flow over at least a part of a peripheral surface of a connecting element. The cooling fluid, e.g. a cooling gas then flows from the bottom side of the grate bar through and/or over the bolt (as pars pro toto for a connection element) and optionally via the gas channel e.g. to the top side of the front section, whereby the bolt can be cooled in a particularly effective way. In order to achieve a continuous gas flow through a hollow bolt, the opening of the recess at the bottom side can be at least partially closed after mounting. A reduction in the diameter of the opening can be achieved, for example, by a plug having a passage with a smaller diameter than that of the opening in the recess. When omitting the passage in the plug, the opening is completely closed.

The gas passages can have webs, for example, which support the stability of the front section, but do not or not significantly affect the gas flow. The webs can extend, for example, from the bottom side to the top side.

The top side of the front section may have a greater longitudinal extent than the bottom side. Due to the difference in length, the rear side has an overhang. The rear side can form, for example, an at least approximately right angle (within ±25°, preferably ±10°, particularly preferred ±2.5° or better) with the bottom side. Alternatively or additionally, the rear side adjoins tangentially to the top side. The rear side can connect the top side to the bottom side in a stepped or curved manner. Preferably, the rear side is continuously curved. The curvature can therefore vary.

In the mounted state, the overhang can serve as a thermal and/or chemical shield for the rear section. The rear section can therefore be made from easily processable, less temperature-resistant materials such as sheet steel. At least a section of the overhang may be above the rear section, and thereby protect the rear section from the thermal and chemical stresses originating from the top surface.

The grate bar rear section, i.e. the "rear section" for short, can be mounted to a front section, for example as described in detail below. The rear section can be made of metal. The rear section preferably has a middle part which is preferably arranged between a first side element and a second side element. However, it can also be made of more or fewer individual components. The middle part can, for example, be an angle profile with a first leg and a second leg. Preferably, the first leg and the second leg are oriented at least approximately orthogonally (i.e. 90°±20°, preferably 90°±10°, particularly preferred 90°±2.5° or orthogonal (90°)) to one another. The common edges of the two legs preferably run parallel to the transverse axis of the grate bar (when mounted as intended). The common edges of the two legs each end on both sides in one of the two long sides of the legs. A leg preferably has at least one through-hole and/or preferably at least one through-opening (i.e. one through-opening, preferably two, three or more through-openings). One of the two side elements, respectively is fastened to the two longitudinal sides of the middle part. The narrow sides correspond to the longitudinal sides of the legs.

The side elements can easily be cut or punched, e.g. from a steel sheet, and are accordingly, like the middle part, inexpensive to manufacture. Reinforcements can be introduced by edging. The expensive technology of cast steel, which is otherwise required for grate bars, can be omitted. Alternatively, the rear section can also be formed as a cast part.

The contour of the side elements is preferably adapted to the transverse struts of a grating substructure, such that the grate bars can simply be suspended into the transverse struts with the rear sections. For this purpose, the side parts can preferably each have at least one cutout, into which a transverse strut engages from below in the mounted state.

Fastening the side elements to the middle part can be performed, for example, by gluing, clamping, screwing or preferably by welding.

The middle part of the grate bar rear section may include a third leg. The third leg can, for example, have a common edge with the second leg. For the sake of simplicity, it is subsequently assumed that the first leg is seated between the second and third legs, i.e. the first leg is the middle leg which preferably has the above-mentioned through-hole.

The third leg is aligned preferably at least approximately parallel (i.e. ±20°, preferably ±10°, particularly preferably ±2.5° or parallel) to the second leg. In this sense, they both form at least approximately a Z-profile together with the first leg, i.e. their free ends point away from each other.

The front section can be connected to the rear section to thereby form a grate bar. Particularly preferred, the connection is releasable, since the less stressed rear section can then be reused particularly easily. As already described at the beginning, the rear section is optional, the front section can also be fastened directly to a support structure. For this purpose, e.g. the connecting element described above can be used.

The middle part of the rear section can abut at least in sections against the rear side of the front section, preferably rest flat. At least the first leg (i.e. the first, second and third leg, preferably the first leg, particularly preferred the first and/or third leg) may rest against the rear side. For example, the middle part can rest against the rear side at at least three different points (preferably flat), wherein the bearing surfaces of the legs can form an abutment. The bottom side of the front section can rest on the third leg.

A leg can be fastened, preferably braced, against the rear side with a bolt passing through the through-hole and the channel. As a result, the front section is consequently joined with the rear section to form a grate bar. The bolt can be a threaded bolt that has either a threaded pin (partially threaded bolt) or a full thread. In this sense, the bolt can also be a screw. The bolt can be inserted into the through-hole of the middle part resting against the rear side. The bolt can be received by the channel and end up in the recess. Again, the term bolt is pars pro toto for a connecting element.

In the recess, the bolt can be connected, for example braced, to a pressure panel resting against the contact surface. The bolt and the pressure panel can be non-releasably connected, for example, by means of a material bond or compression (as an example of a force-fitting connection). The bolt and the pressure panel are preferably connected in a positive locking and releasable manner. The pressure panel can be, for example, a nut with/without a washer or a panel with a connection part provided for a connection. The fastening can be done, for example, by a bayonet locking, a connecting element with barbs or by a thread.

The bolt can, for example, be solid or designed as a hollow bolt. The bolt may have a through-channel extending along the bolt axis with a proximal inlet and a distal outlet. The distal outlet can end in the opening region of a gas channel that connects the recess with the top side in a communicating manner. The terms proximal and distal refer to the position of the bolt in relation to the through-hole of the first leg or the rear side of the front section, respectively. Consequently, the proximal end is located at the through-hole of the first leg or at the rear side of the front section. The distal end denotes the end remote therefrom, in other words, the part of the bolt ending in the recess.

The hollow bolt has the advantage that a gas flowing through the hollow bolt can cool the bolt. In this way, the thermal load impacting on the bolt can be further reduced and the service life of the bolt can be further increased.

The hollow bolt and its distal outlet in the region of the inlet of the gas channel enable, as already described with reference to the gas line and the gas passage, gas which is below the front section to be transported to the top side of the front section. For example, primary or secondary air, e.g. in a waste incineration plant, can flow from the bottom side of the grate to the top side by means of the gas channel. This primary or secondary air is thereby heated, i.e. it absorbs heat from the front section.

The tangents mentioned are of course imaginary tangents which extend orthogonally to the transverse axis of the grate bar or to a parallel of the transverse axis of the grate bar.

BRIEF DESCRIPTION OF THE DRAWINGS

In the following, the invention will be described by way of example, without limitation of the general inventive concept, on examples of embodiments and with reference to the drawings.

Figure 1:
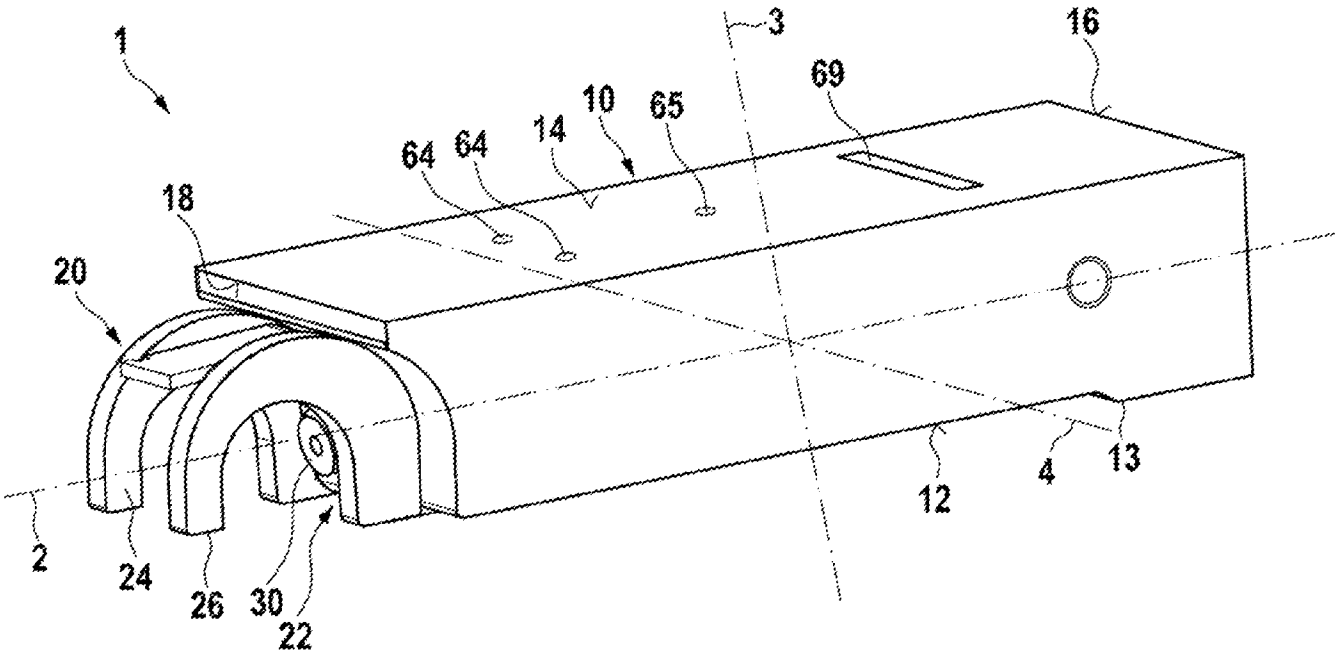
FIG. 1 shows embodiment of a grate bar in the mounted state.

Generally, the drawings are not to scale. Like elements and components are referred to by like labels and numerals. For the simplicity of illustrations, not all elements and components depicted and labeled in one drawing are necessarily labels in another drawing even if these elements and components appear in such other drawing.

While various modifications and alternative forms, of implementation of the idea of the invention are within the scope of the invention, specific embodiments thereof are shown by way of example in the drawings and are described below in detail. It should be understood, however, that the drawings and related detailed description are not intended to limit the implementation of the idea of the invention to the particular form disclosed in this application, but on the contrary, the intention is to cover all modifications, equivalents and alternatives falling within the spirit and scope of the present invention as defined by the appended claims.

DETAILED DESCRIPTION

FIG. 1 shows an embodiment of a grate bar 1 with a front section 10 and a rear section 20. The front section 10 and the rear section 20 are releasably connected with a connecting element 30, which is shown here as a bolt 30 by way of example.

The front section 10 has a front side 16, a rear side 18, a top side 14 and a bottom side 12. The bottom side 12 has an optional shoulder 13. The top side 14 of the front section 10 has, for example, an optional slit-shaped outlet 69 and three optional circular outlets 64, 65, which are explained in more detail with reference to FIG. 2. The number of outlets 64, 65, 69 is merely an example, i.e. to be understood as preferably at least one outlet. The outlets can also be omitted.

As illustrated, the top side 14 preferably has a greater longitudinal extent along the grate bar longitudinal axis 2 than the lower side 12, whereby the rear side 18 has an overhang which covers part of the top side of the rear section 20.

The rear section 20 preferably has a middle part 22, a first side element 24 and a second side element 26, which can be manufactured cost-effectively from sheet steel, for example. Alternatively, the rear section 20 can also be made in one piece or consist of a different number of individual components.

Figure 2:
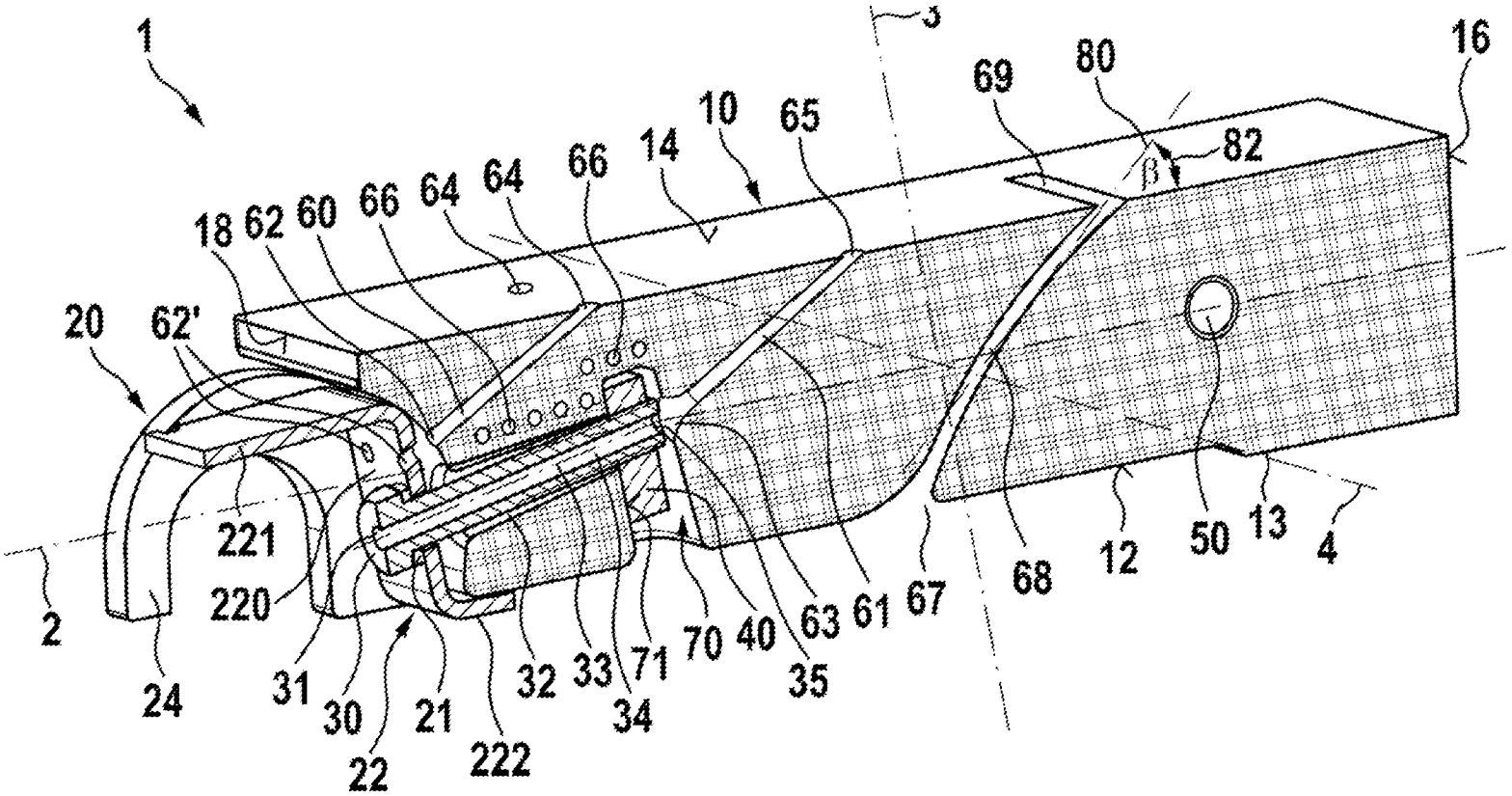
FIG. 2 shows a longitudinal cross-section of the grate bar according to FIG. 1.

In FIG. 2, a longitudinal cross-section of the grate bar described in FIG. 1 is shown. The grate bar 1 has a front section 10 and a rear section 20. The front section 10 has a top side 14, a bottom side 12, a front side 16 and a rear side 18. The front section 10 extends along a grate bar longitudinal axis 2.

The bottom side 12 can have a shoulder 13 in a section adjoining the front side 16. In the region of the front side 16, a clamping means 50 can completely or partially penetrate the front section 10 in the transverse direction. Accordingly, the front section 10 preferably has at least one transverse hole in its anterior one-third for receiving at least one clamping means 50. The transverse hole can be formed as a through-hole or as a blind hole. The optional clamping means 50 can brace the grate bar 1 with further adjacent grate bars, such that a row of grates can be formed.

The top side 14 can have a greater longitudinal extent along the grate bar longitudinal axis 2 than the bottom side 12. Due to the optional difference in the longitudinal extent of the top side 14 and the bottom side 12, the rear side 18 can delimit an optional overhang downwards. Preferably, the rear side 18 can have a planar partial surface which has a common edge with the top side 14. At the planar partial surface, a preferably curved second partial surface of the rear side 18 adjoins, which connects the first partial surface with the bottom side 12.

The bottom side 12 may have an opening. Starting from the opening, a recess 70 extends in the direction of the top side 14. Here, the recess 70 is shown exemplarily as a blind hole and preferably has a bearing surface 71 delimiting the recess in the direction of the rear side. Starting from an opening in the rear side 18, an optional channel 32 extends into the recess 70 along a channel longitudinal axis 33. The channel 32 can preferably taper starting from the rear side 18 in the direction of the recess 70.

The front section 10 can have at least one optional gas line 60, at least one optional gas channel 61 and/or at least one optional gas passage 68. The gas line 60 as well as the gas channel 61 and the gas passage 68 each enable gas (or another fluid) located below the front section 10 to be transported to the top side 14 of the front section 10. The fluid flows (provided there is a corresponding pressure gradient) obliquely to the surface 14, due to the gas line 60, gas channel 61 and gas passage 68 being inclined in the direction of the front side 16, whereby the flow in the direction of the front side 16 is applied to the top side 14.

The optional at least one gas passage 68 extends from an inlet 67 in the bottom side 12 to an outlet 69 in the top side 14, wherein the inlet 67 can have a larger diameter than the gas passage 68, whereby the flow rate in the gas passage 68 increases towards its outlet, which prevents material on the top side 14 from falling through and at least prevents the gas passage 68 from being blocked by material penetrating from above.

As illustrated, the gas passage 68 is preferably curved in the direction of the front side 16 at least in a region adjoining the top side 14. In an alternative variant, the gas passage can also be non-curved. A tangent 80 can be applied to the lower side of the gas passage 68. This tangent 80 forms an acute angle 82 with the top side 14. With decreasing distance of the contact point of the tangent 80 to the outlet 69, the value of the acute angle 82 formed by the tangent 80 and the top side 14 decreases continuously, and the gas passage 68 continuously merges into the top side 14 at the outlet 69, whereby the flow is applied particularly effectively to the top side 14. Herein, the outlet 69 is exemplarily shown as a slot, wherein the longitudinal direction of the slot preferably runs at least approximately parallel (within ±10°, preferably ±5°, 2.5° or better) to the transverse axis 4 of the grate bar.

The at least one optional gas channel 61 extends from an inlet 63 in the recess 70 to an outlet 65 in the top side 14, wherein the inlet 63 preferably may have a larger diameter than the gas channel 61. Here, the outlet 65 exemplarily has a circular cross-section.

A gas line 60 extends from an inlet 62 in the rear side 18 to an outlet 64 in the top side 14. Covered by the front section 10, there is a second optional gas line, the outlet 64 of which also opens into the top side 14. The gas lines 60 are arranged above a plane which is parallel to the grate bar longitudinal axis 2 and the grate bar transverse axis 4 and also above the channel 32. Herein for example, the outlets 64 have a circular cross-section (other cross-sections are also possible, in particular oval or polygonal cross-sections).

Eight optional insulating bodies 66 are aligned here parallel to one another, preferably at least approximately orthogonally to the grate bar longitudinal axis 2 (within ±10°, preferably ±5°, 2.5° or better). In the example shown, the insulating bodies 66 are arranged above the channel 32 and the recess 70 and thus protect the bolt 30 and the pressure panel 40 in the channel 32 and the recess 70, respectively. The number of insulating bodies 66 is also to be understood as an example, i.e. they can be omitted. Preferably, however, at least one insulating body 66 is realized, which is preferably arranged above the channel 32, i.e. the at least one insulating body is preferably arranged above the channel 32 as a heat shield.

The longitudinal cross-section of the rear section 20 shows the middle part 22 and a first side element 24. Herein for example, the middle part 22 has a first leg 220, a second leg 221, and a third leg 222. The legs 220, 221, 222 of the rear section 20 here form, for example, an angle with a Z-profile. However, the rear section can also be embodied with more or fewer individual components.

The first side element 24 of an exemplarily three-part rear section is fastened to the middle part 22, this can preferably be done by a material connection, for example by gluing or preferably welding. The side elements each form a receptacle for a cross beam of a grate substructure on which the rear sections 20 with their side elements 24, 26 (cf. FIG. 1) rest.

The middle part 22 can rest against the rear side 18 in the region of the transition from the first leg 220 to the second leg 221 and in the region of the transition from the first leg 220 to the third leg 222. The middle part 22 can, for example, also rest flat on the rear side 18, or not at all.

The first leg 220 can have at least one through-opening 62' (two through-openings 62' are shown as an example) and at least one through-hole 21. After the mounting described above, the through-channels 62' are arranged in the region of the inlet 62 and of an inlet 62 covered by the middle part 22. By this way, a gas can flow through the gas line 60 despite the mounted rear section 20. The through-hole 21 is arranged in the region of the opening of the channel 32 on the rear side 18.

The bolt 30 is received from the through-hole 21 and the channel 32. The bolt 30 may have a through-channel 34 along the channel longitudinal axis 33, a proximal inlet 31 and a distal outlet 35. A pressure panel 40 is located in the recess 70, wherein the pressure panel 40 rests against the contact surface 71. The bolt 30 is releasably connected to the pressure panel 40, whereby the front section 10 and the rear section 20 are releasably connected. The distal outlet of the bolt can be located in the opening region of the inlet 63 and the proximal inlet is located at the middle part 22. The proximal inlet 31, the through-channel 34 and the distal outlet 35 allow gas to be transported from below the grate bar 1 through the bolt 30 into the gas passage 61 to the top side 14 of the front section 10. The flow through the through-channel 34 can be improved if the opening of the recess 70 is closed with a plug.

Figure 3:
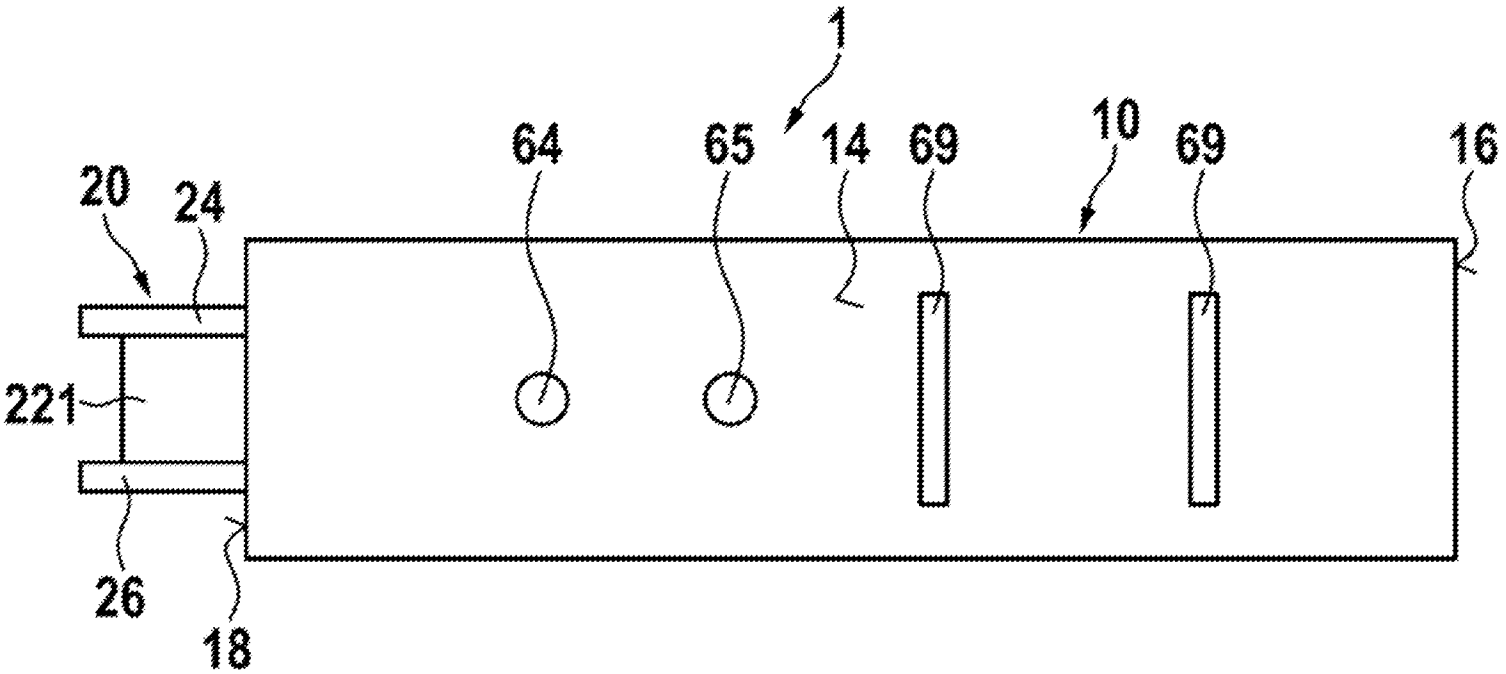
FIG. 3 shows a top view on a further grate bar.
Figure 4:
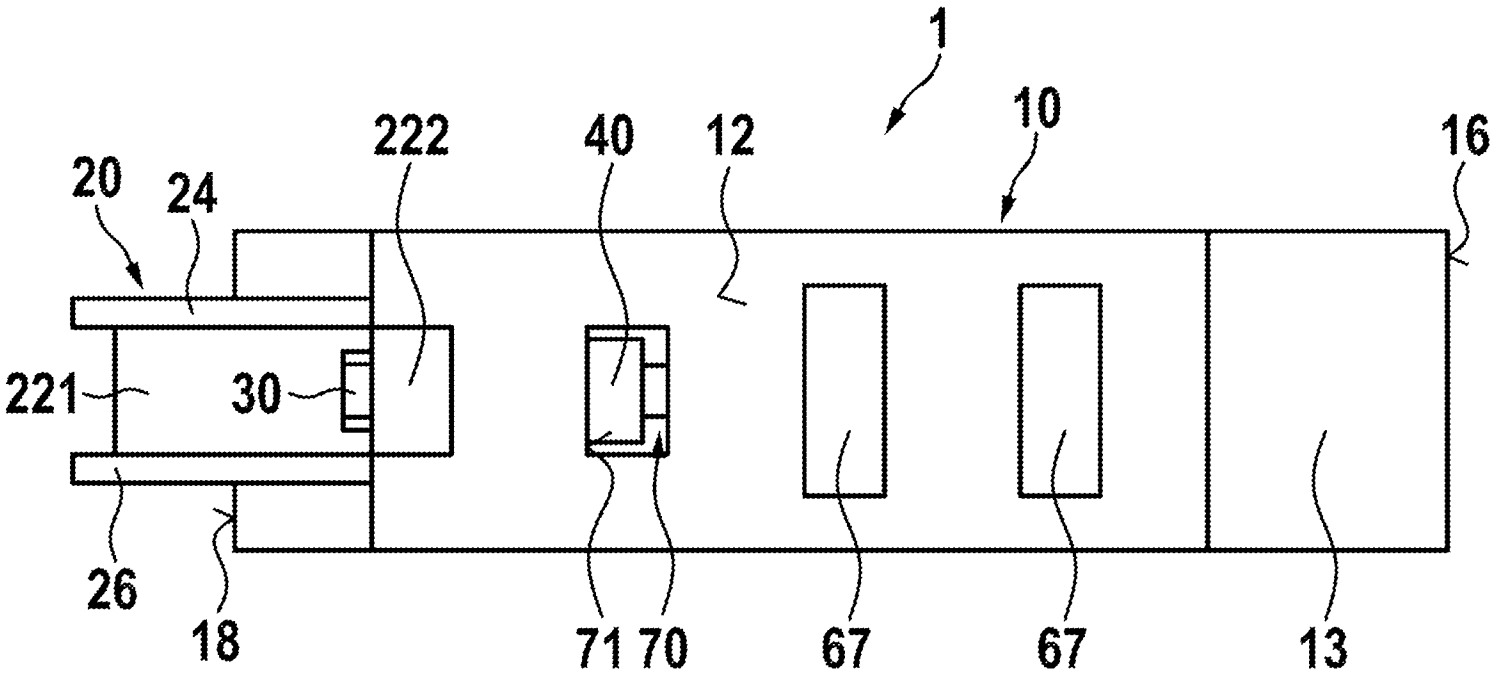
FIG. 4 shows the bottom side of the grate bar according to FIG. 3.

FIGS. 3 and 4 show views of an embodiment of a grate bar similar to that shown in FIGS. 1 and 2. The description of FIGS. 1 and 2 can therefore also be read on FIGS. 3 and 4 (and vice versa), with the exception of the deviations described below. The top view on the grate bar 1 (FIG. 3) shows the top side 14 of the front section 10 and a top view on the rear section 20. The top side 14 can have, for example, two slit-shaped outlets 69 and, for example, two circular outlets 64, 65. The slit-shaped outlets 69 extend exemplarily across the top side 14, wherein across means that the slits are at least approximately parallel to the grate bar transverse axis 4 or at a small angle thereto. The circular outlets 64, 65 can be located centrally. At least one outlet could also exit in the front side. The rear section 20 is located at the rear side 18 of the front section 10. The top view on the rear section 20 shows the upper side of the second leg 221, as well as the upper sides of a first side element 24 and a second side element 26. The side elements 24, 26 are fastened to the second leg 221.

The bottom side 12 (see FIG. 4) of the front section 10 has a common edge with the front side 16 and the rear side 18. In the region of the front side 16, the front section 10 has a shoulder 13 (which can also be omitted). The bottom side 12 includes two inlets 67 as an example of at least one inlet 67, and a recess 70 extends from an opening in the bottom side 12. The recess 70 can overtake the function of a further gas inlet. The recess 70 includes a contact surface 71 against which a pressure panel 40 rests. A connecting element 30, here exemplarily a bolt 30, fastens, for example braces, the rear section 20 to the front section 10, in that the bolt 30 is connected to the pressure panel 40 in a positive locking manner.

The view of the bottom side of the rear section 20 shows a second leg 221, a third leg 222, a first side element 24, and a second side element 26. The bottom side 12 of the front section 10 rests on the third leg 222. The first side element 24 and the second side element 26 are attached at least to the second leg 221 (i.e. to the first, second and third leg 220, 221, 222, preferably to the second leg 221, particularly preferred to the first and second leg 220, 221).

Figure 5:
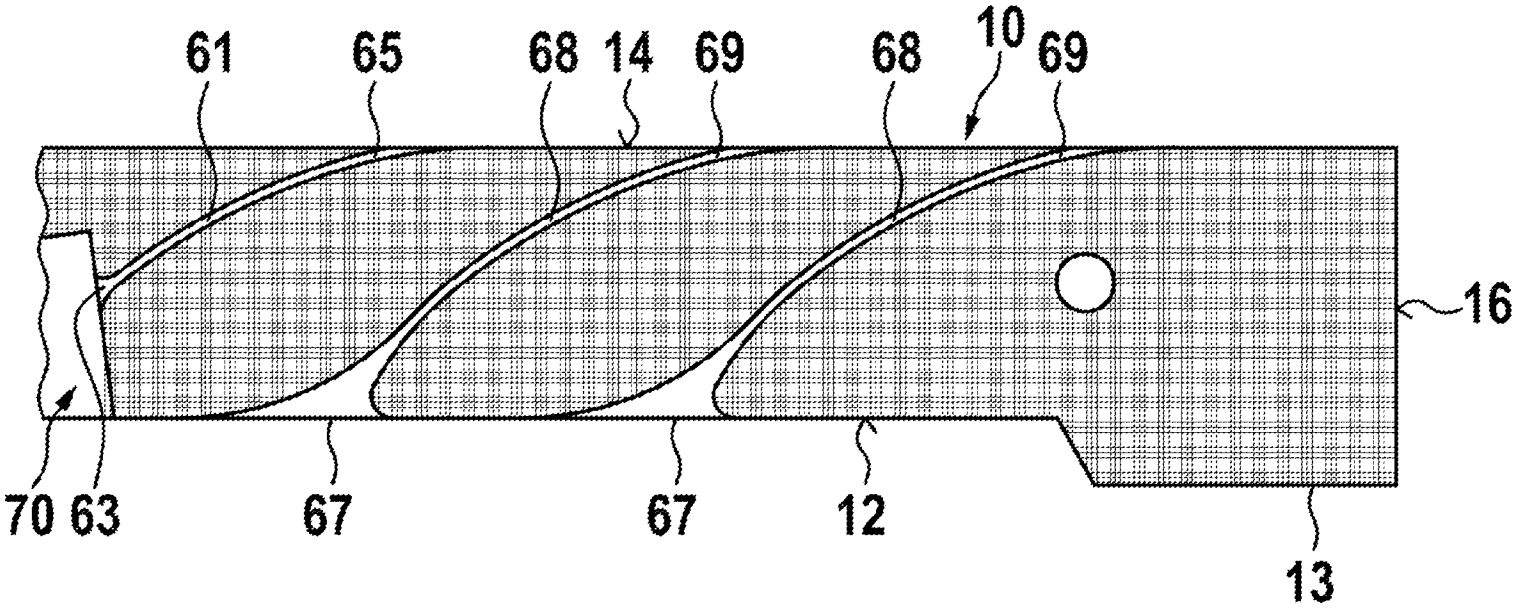
FIG. 5 shows a longitudinal cross-section of a detail of the grate bar according to FIGS. 3 and 4.

FIG. 5 shows a longitudinal cross-section of a schematic partial view of a further embodiment of a front section 10 of a grate bar 1. Again, the description of FIGS. 1 to 4 can also be read on the embodiment according to FIG. 5 (and vice versa), with the exception of the following special features.

The partial view of the front section 10 in FIG. 5 shows the front side 16, the top side 14, the bottom side 12, and the recess 70. The bottom side 12 has a shoulder 13. The longitudinal cross-section exposes gas channel 61 which is curved in the direction of the front side 16, and two as well curved gas passages 68. The two gas passages 68 each extend from an inlet 67 in the bottom side 12 to an outlet 69 in the top side 14.

The optional gas channel 61 extends from an inlet 63 in the recess 70 to an outlet 65 in the top side 14.

Both the gas channel 61 and the gas passages 68 are each curved towards the front side 16 in a region adjacent to the top side 14. A tangent 80 can be applied to the lower side of each of the gas channel 61 and the gas passages 68. These tangents 80 each form an acute angle 82 with the top side 14 (cf. FIG. 2). With decreasing distance between the tangent's 80 contact point to the outlet 69, the value of the acute angle 82 formed by the tangent 80 and the top side 14 decreases continuously and the gas channel 61 as well as the gas passages 68 merge continuously into the top side 14 at the respective outlet 65, 69.

Figure 6:
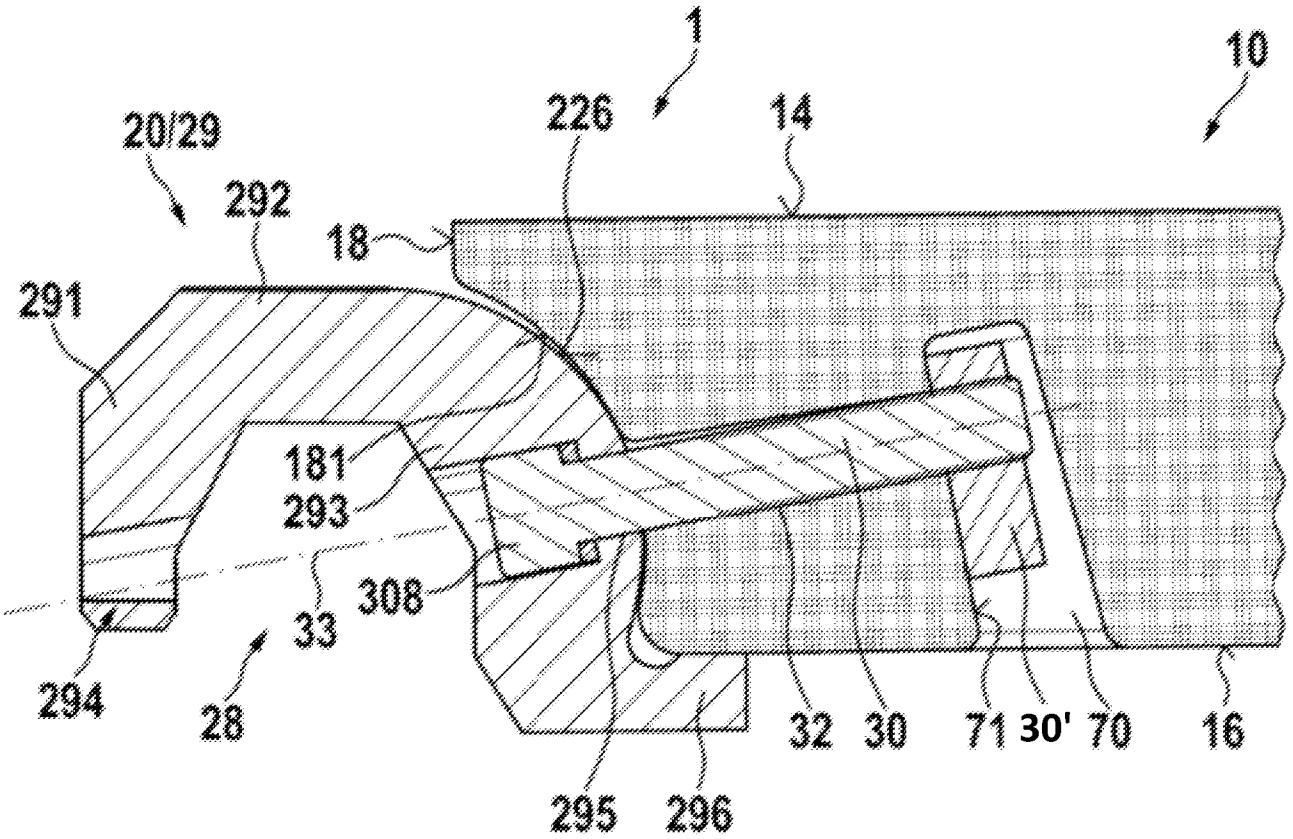
FIG. 6 shows the rear end of a further variant of a grate bar in a schematically simplified manner.

FIG. 6 shows, in a schematically simplified manner, the rear end of a grate bar 1 with a rear section 20 which was fastened to the rear side 18 of a front section 10 via connecting means 30, 30'. For this purpose, the front section 10 has a recess 70 in its bottom side 16, which recess extends in the direction of the top side 14. A channel 32 with a channel longitudinal axis 33 opens into the rearward boundary of the recess 70. The connection means 30, which is shown here exemplarily as a bolt, extends through the channel 32. The rear end 308 of the connecting means 30 penetrates an opening 295 of the rear section 10 and rests with a radial projection against said rear section 10 in a positive locking manner (with interposition of an optional spring ring, a washer, etc.). The front end of the connecting means 30 is connected to a pressure panel 40, herein exemplarily via a thread, wherein said pressure plate rests against the rear boundary of the recess 70, i.e. against a contact surface 71. Alternatively, of course other connection techniques (pressing, wedging, material connection, etc.) are also possible instead of screwing.

The rear side 18 of the front section 10 in FIG. 6 has a concave segment 181 curved at a first radius. A leg of the rear section 20 with a convexly curved surface 226 rests against this first segment 181. The convexly curved surface 226 has a smaller radius of curvature than the concave segment 181. Accordingly, in the event of a sudden load on the grate bar, the connection can flex elastically, with the connecting element 30 serving as an elastic return element. Overloading of the ceramic front section 10, which would lead to its breakage, can thus be prevented.

The rear section 20 in FIG. 6 is embodied in one piece, different than in FIGS. 1 to 4. However, the rear section 20 shown in FIG. 6 can also be mounted on the front sections 10 according to FIGS. 1 to 4 and also enables the grate bar 1 to be hung in a cross-member of a substructure. Accordingly, the rear section 10 in FIG. 6 can be exchanged with a rear section according to one of FIGS. 1 to 5.

The rear section 20 in FIG. 6 has a profile 29 which is open to the bottom, i.e. it has a downwardly opened opening 28. With the opening 28, the grate bar 1 can, for example, be hung in a cross-member, wherein other fastening options are also possible (e.g. screwing, welding, etc.). Accordingly, the rear section 20 can at least approximately form and/or have a U-profile 29 that is downwardly open. In this case, the free end of the rear-sided first leg 291 of the profile points preferably at least approximately downwards. A middle leg 292 adjoins to the first leg 291 in forward direction, which middle leg then merges into a front (third) leg 293. The forward side of the forward leg forms the already described convex surface 226. Preferably, a projection 296 adjoins forwardly at the lower end of the forward leg 293 which projection can serve as a support for the bottom side 16 of the front section 10.

The free end of the rear-sided free leg of the rear section 20 preferably has a mounting recess 294 in the extension of the channel axis 33. The optional mounting recess 294 is preferably located in the extension of the opening 295 in the opposite leg 293, i.e. when mounted, the mounting recess 294 is preferably located at least approximately in the extension of the channel longitudinal axis 33. As a result, the rear end of the connecting element 30 is easily accessible fora mounting tool.

Figure 7:
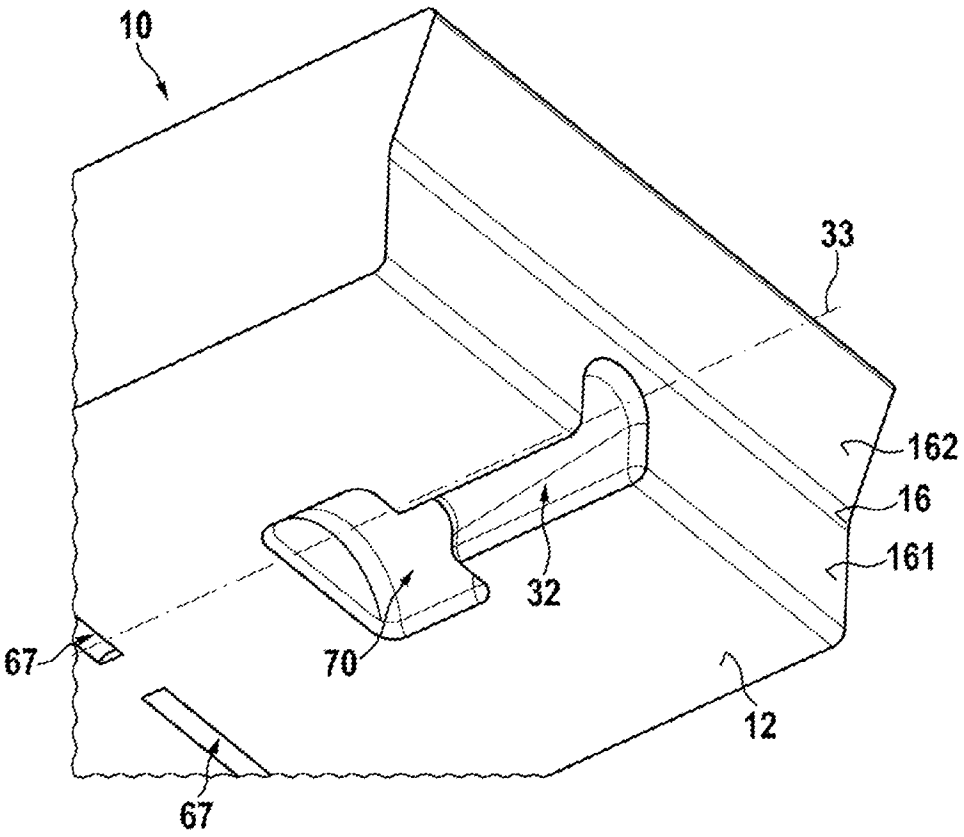
FIG. 7 shows a view of a rear-sided section of yet another grate bar front section.
Figure 8:
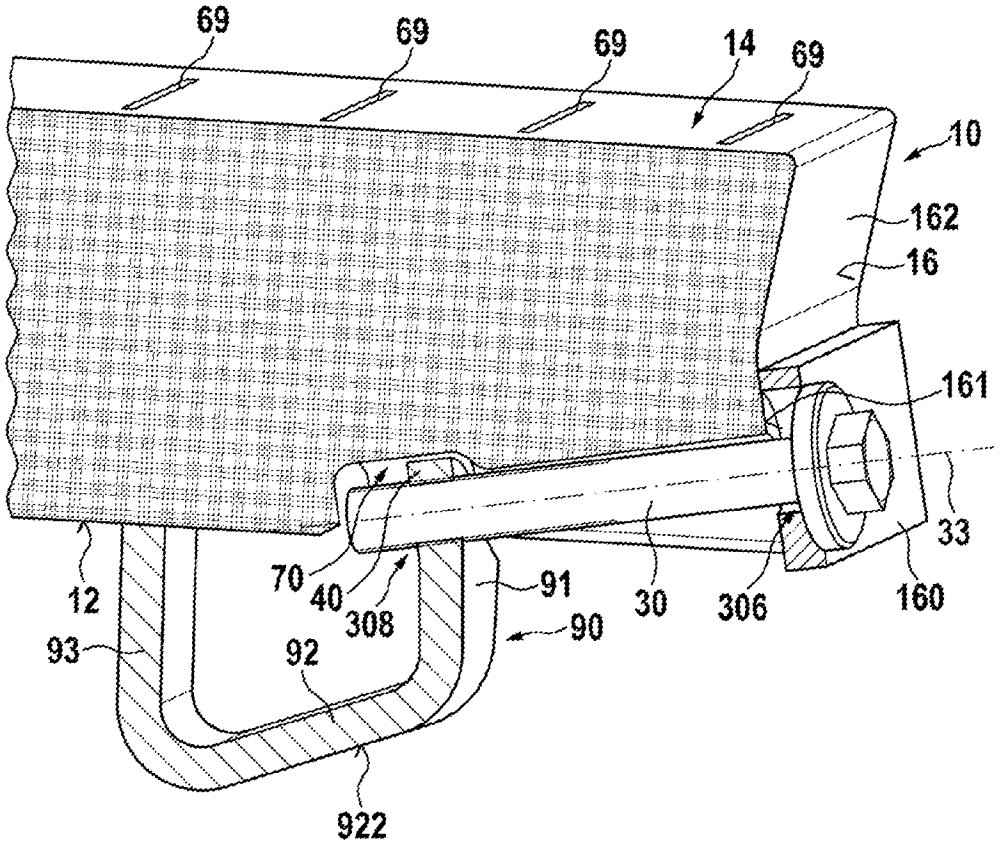
FIG. 8 shows a perspective partial cut of the grate bar front section according to FIG. 7 with a grate bar rear section.

FIGS. 7 and 8 show an alternative front section of a grate bar front section 10 which can apart from that be designed as in FIGS. 1 to 5. The description of FIGS. 1 to 4 and 8 to 9 also reads on FIGS. 7 and 8. Therefore, in the following only differences are discussed: As shown in FIGS. 6 and 7, the front section 10 can have a recess 70 in its front section in the bottom side 12, which recess extends in the direction of the top side 14. Starting from the recess 70, the channel 32 may extend along a channel longitudinal axis 33. The optional channel 32 connects the recess 70 to the front side 16 in this example, and is shown here exemplarily as a channel 32 being open downwards, i.e. to the bottom side 12. Such a downwardly open channel 30 is particularly easy to manufacture and improves the cooling of the connecting means 30. Alternatively, the channel 32 can, however, also be formed as shown in FIGS. 1 to 6. Likewise, the channels 32 according to FIGS. 1 to 6 can be designed as channels 32 which are open to the bottom.

As shown in FIG. 8, a front panel 160 can be fastened to the front side 16 by means of the connecting element 30. For this purpose, a front section 306 of the connecting element 30 penetrates a recess in the front panel 160 and rests with a radial projection against the front side 161 of the front panel 160 (here with interposition of an optional spring ring, a washer, or the like). The rear end 308 of the connecting element can be supported via a pressure panel 40 against the wall of the recess 70. In FIG. 7, the pressure panel 40 is exemplarily integrated into an optional skid 90.

As can be clearly seen in FIGS. 7 and 8, the front side 16 of the front section 10 can have at least two segments 161, 162. In this example, the front panel 160 rests at least approximately flush with at least one of the two segments 161, 162. The surface normal of this first segment 161 is preferably at least approximately parallel to the channel longitudinal axis 33. Correspondingly, when the front panel 160 is braced against the front side 16, at least essentially compressive forces are introduced into the front section 10. As shown, this first segment 161 can be adjoined by a second segment 162 which is angled in relation to the first segment. An overhang can optionally be formed by the angling.

The optional skid 90 (see FIG. 8) can for example have a bracket with for example three legs 91, 92, 93. One leg engages with a section, that also at least partially forms the pressure panel 40, in the recess 70 of the front panel. An angled second leg 92 can adjoin to this first leg 91. The second leg 92 can have a bottom side 922 which can then form the bottom side of the skid 90. With the bottom side 12 or with a section of the bottom side 12, the skid 90 can then rest, e.g. rest slidably on a support. The top side 14 of a front section located upstream in the conveying direction can be used as a support, for example. The second leg 91 preferably merges via a further angle into a third leg 93. The skid 90 can support the front section 10 on its bottom side 12, for example with an end face of the third leg 93. In the example shown, the front section 10 consequently rests on an upwards pointing end of the third leg 93.

Figure 9:
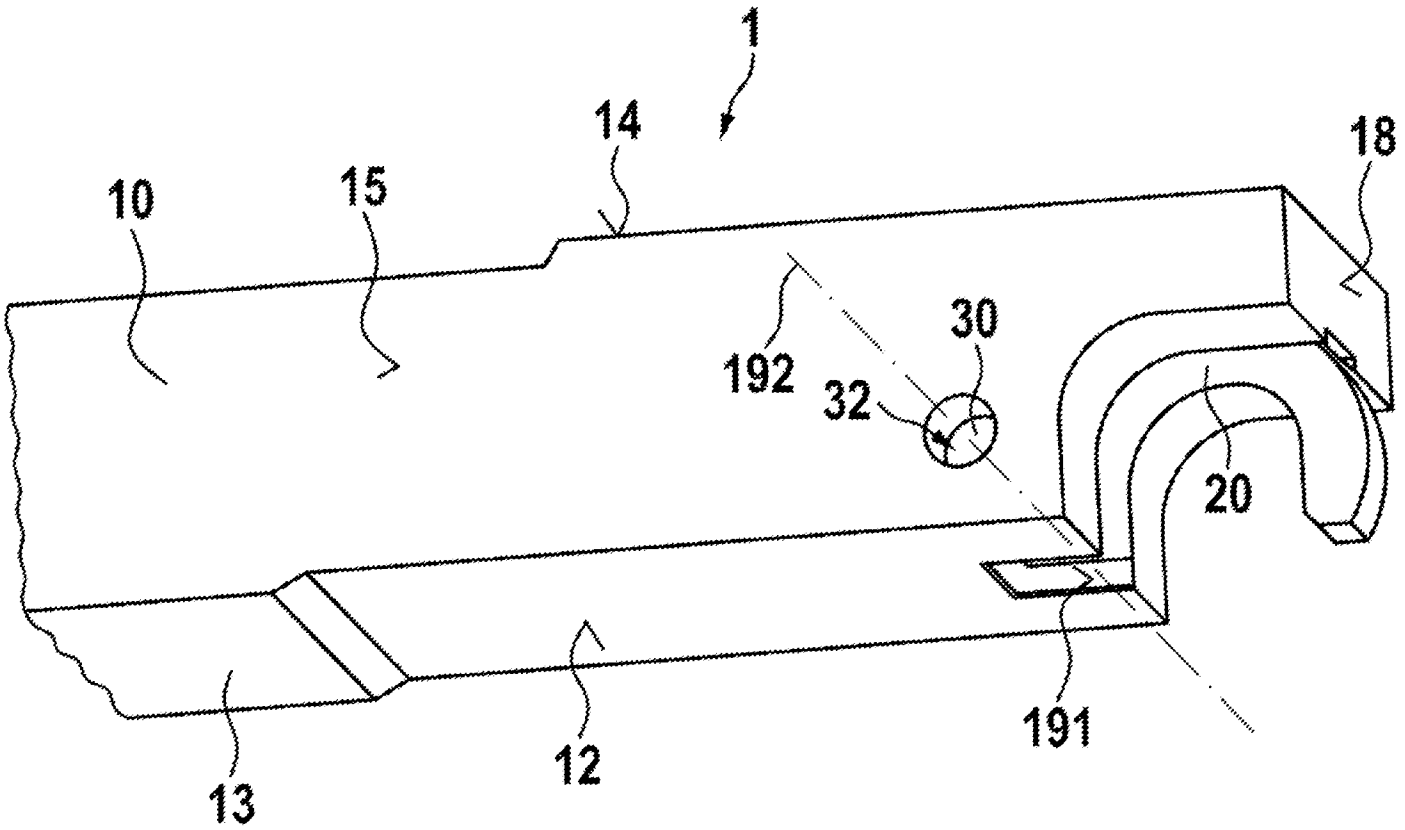
FIG. 9 shows the rear end of a further grate bar in a schematically simplified manner.
Figure 10:
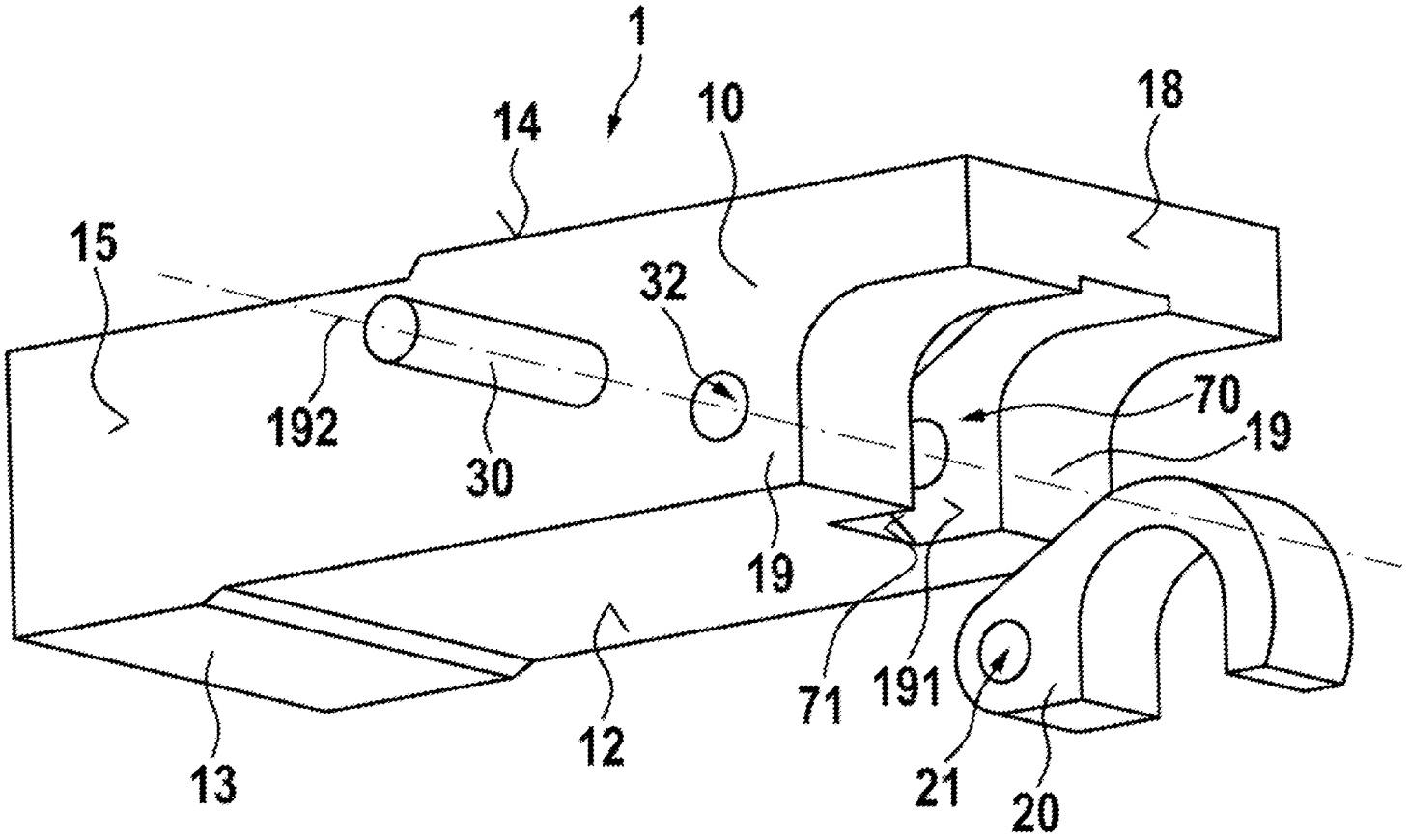
FIG. 10 shows an exploded view of the grate bar of FIG. 9.

FIGS. 9 and 10 show in a schematically simplified manner a further variant of a grate bar in the assembled state (FIG. 9) or as an exploded view (FIG. 10), respectively. Like all other variants described here, the grate bar 1 has a grate bar front section 10 and a grate bar rear section 20. Optional gas channels 61 as well as optional gas passages 68 as in FIGS. 1 to 8 are not illustrated in this variant for the sake of simplicity, but can also be provided. The same applies accordingly to the optional clamping means 50 and at least one optional transverse hole in the anterior one-third of the front section 10 for receiving at least one clamping means 50 and for fastening of an optional bracket 90 and/or a front panel 160 according to FIGS. 7 and 8.

In its rear one-third, the front section 10 has a recess 70 which is open rearwards and downwards (cf. FIG. 10). The recess 70 is delimited upwards and laterally by preferably ceramic material of the front section 10. That means, the front section has at least one web 19 which delimits the recess in the lateral direction. The webs 19 each can be delimited e.g. inwards by opposing inner surfaces 191 and outwards by the side surfaces 15 of the front section 10. The two webs 19 are each penetrated by a transverse channel 32. The two transverse channels have a common longitudinal axis 192. In this example, the recess 70 has the function of the channel 32 in FIGS. 2, 6 and 7 and could also be referred to as such. The transverse channel 32 has the function of the recess 70 in FIGS. 2, 6 and 7 and could consequently also be referred to as such.

A preferably metallic hook 20 can be inserted into the recess 70 preferably at least approximately flush (cf. FIGS. 9 and 10). Here, the hook 20 forms the rear section 20. The rear section 20 has, for example, a claw-like opening 28 opening downwardly, with which the grate bar can be hung in a cross-member. Furthermore, the rear section 20 has a through-hole 21, which is designed here as a transverse hole (cf. FIG. 10). In the mounted state (cf. FIG. 9), a transverse bolt 30 sits in the through-hole 21 and the two transverse channels 32. The pivoting angle of the rear section 20 about the transverse axis 192 is restricted by contact surfaces 71. The contact surfaces 71 delimit the recess 70 upwards and downwards, respectively.

Figure 11:
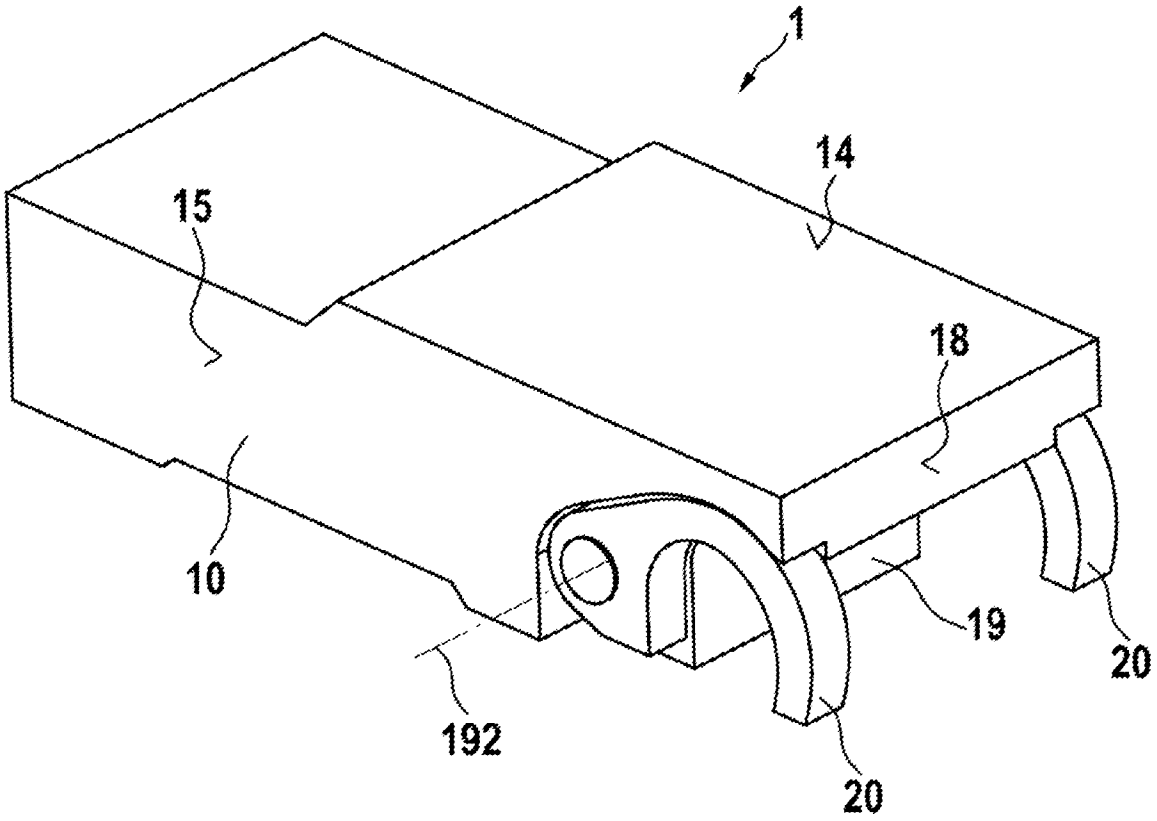
FIG. 11 shows the rear end of yet another grate bar in a schematically simplified manner.
Figure 12:
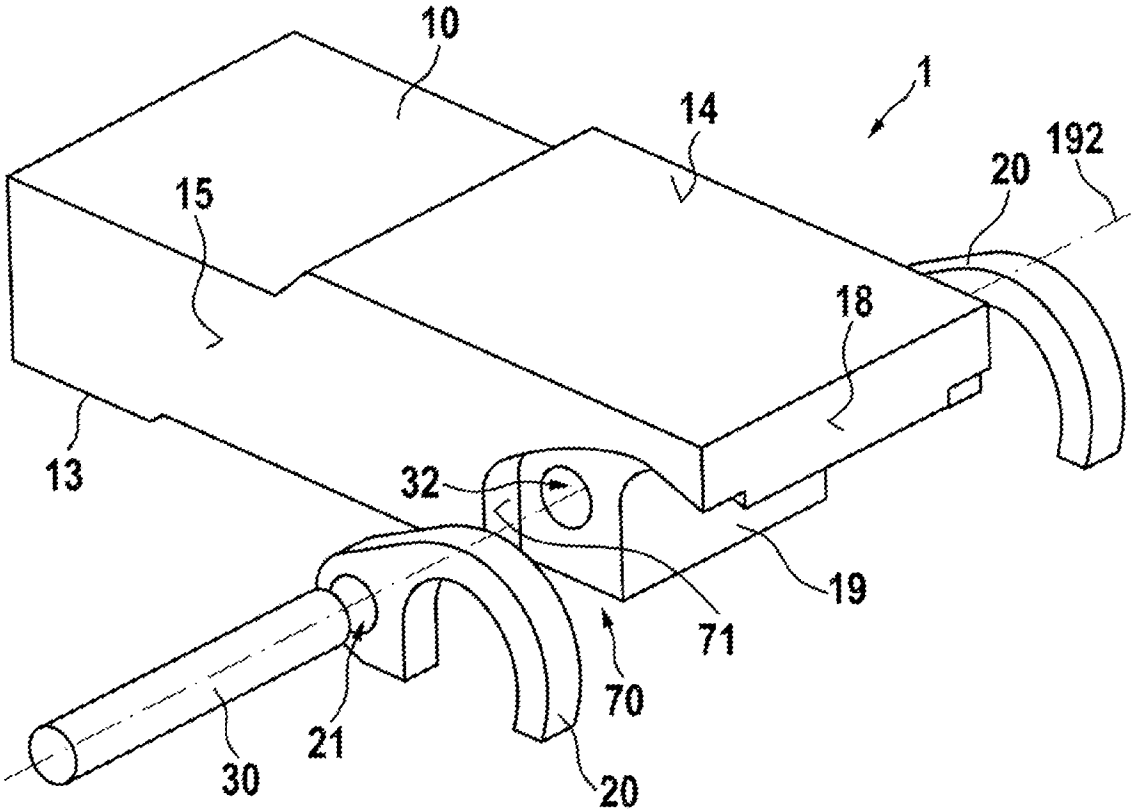
FIG. 12 shows an exploded view of the grate bar of FIG. 11.

FIGS. 11 and 12 show in a schematically simplified manner a further variant of a grate bar in the mounted state (FIG. 11) or as an exploded view (FIG. 12). This variant is very similar to the variant shown in FIGS. 9 and 10. The description of FIGS. 9 and 10 therefore also reads on FIGS. 11 and 12. The main difference between the two variants is that the variant according to FIGS. 11 and 12 has two hooks 20 which together form the rear section 20. These two hooks 20 are each seated in a recess 70 which, unlike in FIGS. 9 and 10, is also open to one side, respectively, i.e. between the two recesses, the front section 10 forms at least one web 19 with at least one through-hole 32. The two hooks 20 are each fastened in a recess 70 with a bolt 30. The embodiments according to FIGS. 9 and 11 can also be combined, i.e. three (or more) hooks 20 can be provided, each sitting in a recess 70 between which preferably at least one optional web 19 extends. The two lateral recesses 70 in FIGS. 11 and 12 can be laterally closed, e.g. by another web 19 (cf. FIGS. 9 and 10). The bolt 30 was described here as being in one piece, i.e. a bolt fixes the hook(s) 20. Alternatively, two or more bolts 30 can also be provided which serve as pins in FIGS. 9 to 12 to absorb forces impacting in radial direction. For example, at least one bolt 30 can be provided for each hook 20. The term "bolt 30" should therefore be understood as "at least one bolt 30".

It will be appreciated to those skilled in the art having the benefit of this disclosure that this invention is believed to provide a grate bar front section and a matching grate bar rear section, as well as a grate bar with the grate bar front section and/or the grate bar rear section. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

1 grate bar
2 grate bar longitudinal axis
3 grate bar vertical axis
4 grate bar transverse axis
10 grate bar front section, in short: front section
12 bottom side
13 shoulder
14 top side
15 side surface
16 front side
160 front panel
161 first segment of the front side 16
162 second segment of front side 16
18 rear side
19 web
191 inner surface
192 axis
181 concave surface segment
20 grate bar rear section, short: rear section
21 through-hole
22 middle part
226 convex surface segment
24 first side element
26 second side element
28 opening
29 profile
291 first profile leg
292 middle leg of the profile
293 second profile leg
294 mounting recess
295 opening for connecting means
296 projection
30 30' bolt/connecting element
306 front section/front end of the connecting element
308 rear section/rear end of the connecting element
31 proximal inlet
32 channel
33 channel longitudinal axis
34 through-channel
35 distal outlet
40 pressure panel
50 clamping device
60 gas line
61 gas channel
62 inlet
62' through-hole
63 inlet
64 outlet
65 outlet
66 insulation body
67 inlet
68 gas passage
69 outlet
70 recess
71 contact surface
80 tangent
82 acute angle
90 skid
91 first leg
92 second leg
922 bottom side of the skid e.g. bottom of the second leg 92
93 third leg
220 first leg
221 second leg
222 third leg

The invention claimed is:

1. A grate bar front section configured for being mounted to a grate bar rear section, in order to form by such mounting a grate bar, wherein the grate bar front section includes a refractory mineral material and a top side, a bottom side, a front side, two narrow sides, and a rear side as well as a grate bar longitudinal axis that extends parallel to the top side through the front side and the rear side, wherein:

the grate bar front section includes a recess that extends from the bottom side in a direction of the top side, the recess has at least one contact surface configured to introduce a force acting in a direction of the rear side and/or the front side into the grate bar front section, the grate bar front section includes at least one channel with a channel longitudinal axis, the at least one channel connecting the rear side and/or the front side with the recess, starting from the rear side, at least one gas line extends in a direction of the top side and/or the front side, the at least one gas line has an inlet at the rear side and an outlet at the top side and/or at the front side, and at least one section of the at least one gas line is located above a plane that is parallel to the grate bar longitudinal axis of the grate bar front section and above the at least one channel.

2. A grate bar front section according to claim 1, wherein the at least one channel is at least partially open to the bottom side.

3. A grate bar front section according to claim 1, comprising at least one section of an insulating body that extends between the at least one channel and the top side and/or between the recess and the top side.

4. A grate bar front section according to claim 1, comprising at least one gas passage that extends from the bottom side in the direction to the top side and/or the front side, wherein the at least one gas passage has an inlet in the bottom side and an outlet in the top side and/or the front side.

5. A grate bar front section according to claim 4, wherein the at least one gas passage has a longitudinal axis that forms an acute angle with the top side or the front side.

6. A grate bar front section according to claim 4, wherein the at least one gas passage is curved towards the front side at least in a region adjacent to the top side, the top side and a tangent form an acute angle, wherein the tangent is defined at a point of a lower side of the at least one gas passage a region adjacent to the top side, and a value of the acute angle decreases as a distance between said point and the outlet is decreasing.

7. A grate bar front section according to claim 6, wherein the value of the acute angle decreases continuously as the distance between said point and the outlet is decreasing and/or wherein the at least one gas passage merges continuously into the top side at the outlet.

8. A grate bar front section according to claim 1, wherein a longitudinal extent of the top side is greater than that of the bottom side, whereby the rear side and/or the front side has an overhang.

9. A grate bar rear section configured for being mounted to a grate bar front section, in order to form by such mounting a grate bar, wherein the grate bar rear section has a middle part, a first side element, and a second side element, wherein:

the middle part has at least a first leg and a second leg, wherein the first leg and the second leg form an angle profile, the first leg has at least one through hole, and the middle part has two longitudinal sides and on each side of the two longitudinal sides of the middle part one of the first and second side elements is attached, respectively, and the middle part has a third leg, the second leg and the third leg point in opposite directions and axes of the second and third legs form an angle with a value within ±30°, wherein the first leg is the middle leg.

10. A grate bar rear section according to claim 9, wherein the first leg has at least one through-opening.

11. A grate bar front section configured to be mounted to a grate bar rear section to form by such mounting a grate bar, wherein:

the grate bar front section includes a refractory mineral material and a top side, a bottom side, a front side, two narrow sides, and a rear side as well as a grate bar longitudinal axis that extends parallel to the top side through the front side and the rear side, wherein:

the grate bar front section includes a recess that extends from the bottom side in a direction of the top side, the recess has at least one contact surface configured to introduce a force acting in a direction of the rear side and/or the front side into the grate bar front section, and the grate bar front section includes at least one channel with a channel longitudinal axis, the at least one channel connecting the rear side and/or the front side and/or at least one side surface with the recess, the grate bar front section further comprising at least one gas passage that extends from the bottom side in the direction to the top side and/or in a direction to the front side, wherein the at least one gas passage has an inlet in the bottom side and an outlet in the top side and/or the front side, wherein the at least one gas passage is curved towards the front side at least in a region adjacent to the top side, the top side and a tangent forming an acute angle, wherein the tangent is defined at a point of a lower side of the at least one gas passage a region adjacent to the top side, and wherein a value of the acute angle decreases as a distance between said point and the outlet is decreasing.

12. A grate bar front section according to claim 11, wherein the value of the acute angle decreases continuously as the distance between said point and the outlet is decreasing and/or wherein the at least one gas passage merges continuously into the top side at the outlet.

13. A grate bar front section configured for being mounted to a grate bar rear section, in order to form by such mounting a grate bar, wherein the grate bar front section includes a refractory mineral material and a top side, a bottom side, a front side, two narrow sides, and a rear side as well as a grate bar longitudinal axis that extends parallel to the top side through the front side and the rear side, wherein:

the grate bar front section includes a recess that extends from the bottom side in a direction of the top side, the recess has at least one contact surface configured to introduce a force acting in a direction of the rear side and/or the front side into the grate bar front section, the grate bar front section includes at least one channel with a channel longitudinal axis, the at least one channel connecting the rear side and/or the front side with the recess, the grate bar front section comprising at least one gas passage that extends from the bottom side in the direction to the top side and/or the front side, wherein the at least one gas passage has an inlet in the bottom side and an outlet in the top side and/or the front side, and wherein the at least one gas passage has a longitudinal axis that forms an acute angle with the top side or the front side.

14. A grate bar front section according to claim 13, wherein the at least one gas passage is curved towards the front side at least in a region adjacent to the top side, the top side and a tangent form an acute angle, wherein the tangent is defined at a point of a lower side of the at least one gas passage a region adjacent to the top side, and a value of the acute angle decreases as a distance between said point and the outlet is decreasing.

15. A grate bar front section according to claim 14, wherein the value of the acute angle decreases continuously as the distance between said point and the outlet is decreasing and/or wherein the at least one gas passage merges continuously into the top side at the outlet.

16. A grate bar front section according to claim 13, wherein a longitudinal extent of the top side is greater than that of the bottom side, whereby the rear side and/or the front side has an overhang.

17. A grate bar front section according to claim 13, wherein the at least one channel is at least partially open to the bottom side.

18. A grate bar front section according to claim 13, wherein starting from the rear side, at least one gas line extends in a direction of the top side and/or the front side, wherein the at least one gas line has an inlet at the rear side and an outlet at the top side and/or at the front side.

19. A grate bar front section according to claim 18, wherein at least one section of the at least one gas line is located above a plane that is parallel to the grate bar longitudinal axis of the grate bar front section and above the at least one channel.

20. A grate bar front section according to claim 13, comprising at least one section of an insulating body that extends between the at least one channel and the top side and/or between the recess and the top side.

* * * * *